United States Patent [19]

Lewallyn

[11] 4,207,787

[45] Jun. 17, 1980

[54] SWATCH CUTTING SYSTEM

[76] Inventor: Michael Lewallyn, P.O. Box 1361, Dalton, Ga. 30720

[21] Appl. No.: 932,653

[22] Filed: Aug. 10, 1978

[51] Int. Cl.[2] ..... B26D 11/00

[52] U.S. Cl. ..... 83/23; 83/81; 83/157; 83/210; 83/255; 83/408

[58] Field of Search ..... 83/47, 122, 210, 255, 83/408, 81, 157, 23

[56] References Cited

U.S. PATENT DOCUMENTS

| | | | |
|---|---|---|---|
| 594,796 | 11/1897 | Hofheimer | 83/408 X |
| 595,092 | 12/1897 | Bosley | 83/122 X |
| 633,321 | 9/1899 | Kitchen | 83/408 |
| 2,159,282 | 5/1939 | Marino | 83/408 X |
| 2,458,612 | 1/1949 | Luzzato et al. | 83/210 |
| 3,620,114 | 11/1971 | Chudyk | 83/408 X |
| 3,621,743 | 11/1971 | Feighery et al. | 83/408 |
| 3,657,952 | 4/1972 | Brockbank et al. | 83/408 X |
| 3,815,458 | 6/1974 | Jirousek | 83/408 X |

*Primary Examiner*—J. M. Meister
*Attorney, Agent, or Firm*—Jones, Thomas & Askew

[57] ABSTRACT

An apparatus for cutting sheets of carpet into a number of rectangular swatches comprises a gang slitter including a plurality of disc cutting blades mounted on a single shaft for making a plurality of parallel cuts in the sheet of carpet moving through the blades, thus cutting the carpet into a plurality of long strips of predetermined width, and a cross cut blade which moves across the sheet of carpet to make a cut in the carpet perpendicular to the plurality of parallel cuts, thus cutting the long strips of carpet material into shorter rectangular swatches. The sheet of carpet material is automatically fed through the gang slitter and stopped for the cross cut, and the swatches are discharged from the apparatus.

5 Claims, 7 Drawing Figures

SWATCH CUTTING SYSTEM

BACKGROUND OF THE INVENTION

The present invention relates to a method and apparatus for cutting swatches from a sheet of carpet.

Carpet swatches are used extensively by carpet sales people, by contractors, decorators and homeowners as samples of the larger carpet which they may eventually use in homes or offices. Swatches are made by simply cutting a scrap piece of carpet from the original larger roll and then cutting the scrap piece into small rectangular pieces called swatches. These small swatches are generally cut on a press or clicker with a die. The production rate of the existing press operations is relatively low, approximately twelve, two by two inch squares of carpet being cut per minute.

SUMMARY OF THE INVENTION

Briefly described, the present invention comprises a method and apparatus for automatically cutting sheets of carpet into small swatches. The invention uses rotating disc blades rather than presses or dies.

The method comprises feeding the sheet of carpet into and through a rotating gang slitter which includes a plurality of spaced apart disc cutting blades. A rotating grooved roll is positioned below the cutting blades. The narrow grooves of the grooved roll act as blade channels allowing the cutting edges of the cutting blades to penetrate below the plane of the carpet as the carpet is fed between the rolls. The blades and grooved roll are both driven at slow rpm giving a slicing, scissor like action producing smooth accurate cuts. The cutting blades and grooved roll cooperate to make a plurality of parallel cuts in the sheet of carpet to cut the carpet into a plurality of narrow strips. The width of the strips is predetermined by the planned spacing of the cutting blades from one another along a common axle.

The narrow strips are fed on through the gang slitter to a position beyond the path of a cross cut blade until the leading edge of one of the strips intersects a photocell light beam or similar switch, whereupon the feeding of the sheet material through the gang slitter is interrupted and the cross cut blade is energized and moves laterally across the path of the cut strips of carpet and makes a cut across the strips of carpet perpendicular to the plurality of parallel cuts, thus cutting the series of narrow strips into short rectangular swatches. The length of the swatches is regulated by moving the photocell closer to or further away from the path of the cross cut blade so as to regulate the distance the cut strips move beyond the path of the cross cut blade before terminating the movement of the strips and cutting across the strips. After the strips have been cut into swatches, the swatches are removed from the system and the cycle of operation is repeated.

It is therefore an object of the present invention to provide a system for cutting sheets of carpet into small swatches which is fast and automatic.

Another object of the present invention is to provide an apparatus for cutting sheets of carpet into small swatches which uses rotating cutting blades the cutting edges of which are set within grooved channels formed in a rotating grooved roll.

Other objects, features and advantages of the present invention will become apparent upon reading the following specification, when taken in conjunction with the accompanying drawings.

DETAILED DESCRIPTION

Figure 1:
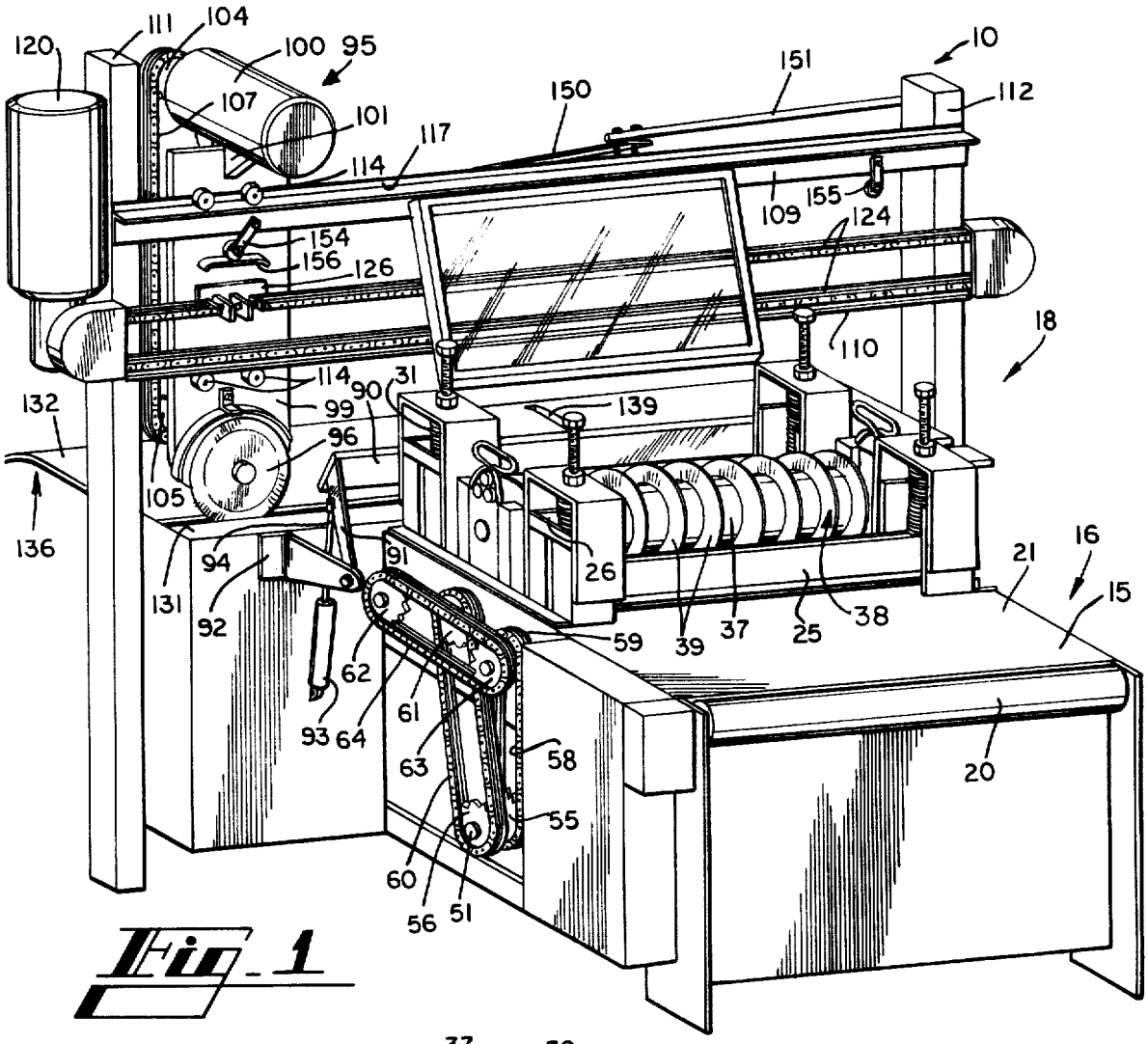
FIG. 1 is a perspective illustration of the swatch cutting apparatus of the present invention.
Figure 4:
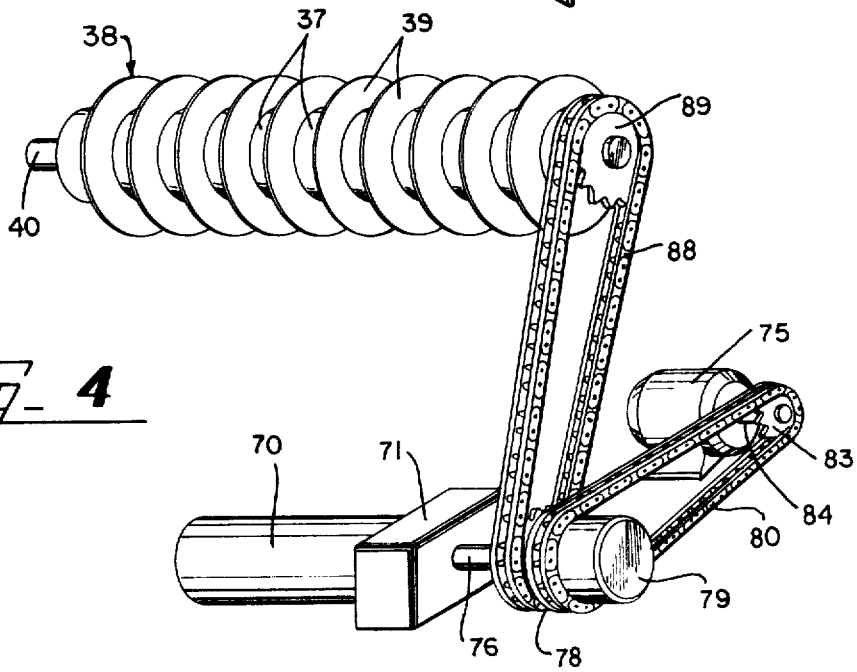
FIG. 4 is an isolated view of the gang drive system of the swatch cutting apparatus in FIG. 1.
Figure 2:
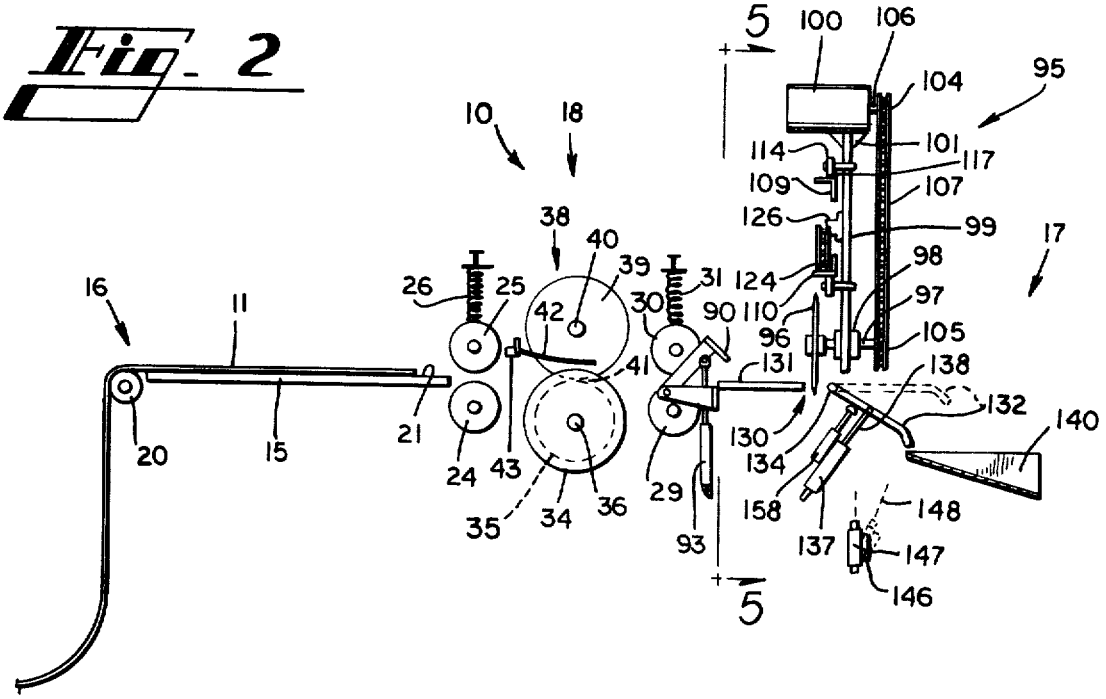
FIG. 2 is a schematic side view of the swatch cutting apparatus of FIG. 1 with parts of the framework removed for clarity.
Figure 7:
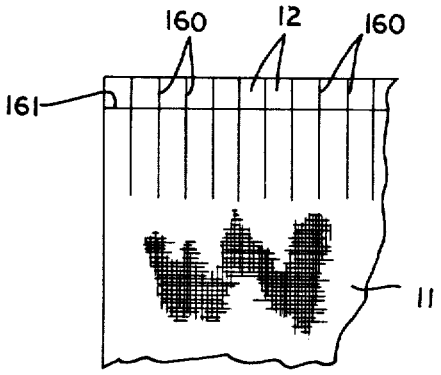
FIG. 7 is a top view of a sheet of carpet cut in accordance with the system of the present invention.

Referring now in more detail to the drawings in which like numerals represent like components throughout the several views, FIGS. 1 and 2 show the swatch cutting apparatus 10 which cuts sheets of carpet 11 (FIG. 7) into rectangular swatches 12, and the swatch cutting apparatus comprises a work table 15 with a carpet feed end or front end 16 and a swatch collecting end or rear end 17. Beginning at the carpet feed end 16, the swatch cutting apparatus 10 includes a free rolling travel roll 20 and a flat work surface 21. The travel roll 20 guides the sheet material onto the work surface 21. Cutting zone 18 is located at the end of the work surface 21 and includes a first feed roll 24 rotatable about a horizontal axis and located with its upper surface at the level of the work surface, a first nip roll 25 positioned parallel to and over the first feed roll 24 and biased by springs 26 against the first feed roll, a second feed roll 29 of the same diameter as first feed roll 24 positioned adjacent the swatch collecting end 17 of the apparatus and also rotatable about a horizontal axis and located with its upper surface at the level of the work surface, and a second nip roll 30 positioned parallel to and over the second feel roll 29 and biased by springs 31 against the second feed roll. Positioned between the two feed rolls 24, 29 is a grooved roll 34 rotatable about a central horizontal axis 36 and which comprises an annular surface interrupted by a series of annular grooves 35 spaced equal distances apart along its length. The grooves 35 in the disclosed embodiment are $\frac{1}{8}''$ wide, $\frac{3}{4}''$ deep and are spaced $\frac{1}{4}''$ on center. The grooved roll is also located with its upper surface at the level of work surface 21. Directly over the grooved roll 34 is a gang slitter 38 which comprises a plurality of spaced apart circular cutting blades 39 mounted on a common rotatable shaft 40. The common rotatable shaft, or axis 40 of the gang slitter 38, is parallel to the central axis 36 of the grooved roll 34. The two axes 40, 36 are located at such a distance from one another that a portion 41 of each cutting blade 39 passes within one of the annular grooves 35 of the grooved roll 54. The disc cutting blades 39 each comprise a pinch collar 37 which is rigidly attached to the blade 39, and each blade is releasibly mounted to the rotatable shaft 40 by drawing the pinch collar 37 tightly around the shaft 40 using a clamp screw (not shown). The blades 39 can be mounted at various positions along the length of the shaft 40 so that the spaces between the blades can be varied. This is accomplished by loosening the pinch collars 37 and sliding the blades 40 along the shaft. Since the grooves 35 of the grooved roll are located close to one another, the disc blades 39 can register with various ones of the grooves to cut wide or narrow strips in the sheet material.

A plurality of spring loaded wire fingers 42 are each mounted at one of their ends to a support bar 43 between nip roll 25 and gang slitter 38. At least one wire finger 42 extends into each space between adjacent ones of the disc blades 39 on beyond shaft 40 so that the distal ends of the wire fingers tend to urge the strips of material 11 out from between the adjacent disc blades.

Figure 3:
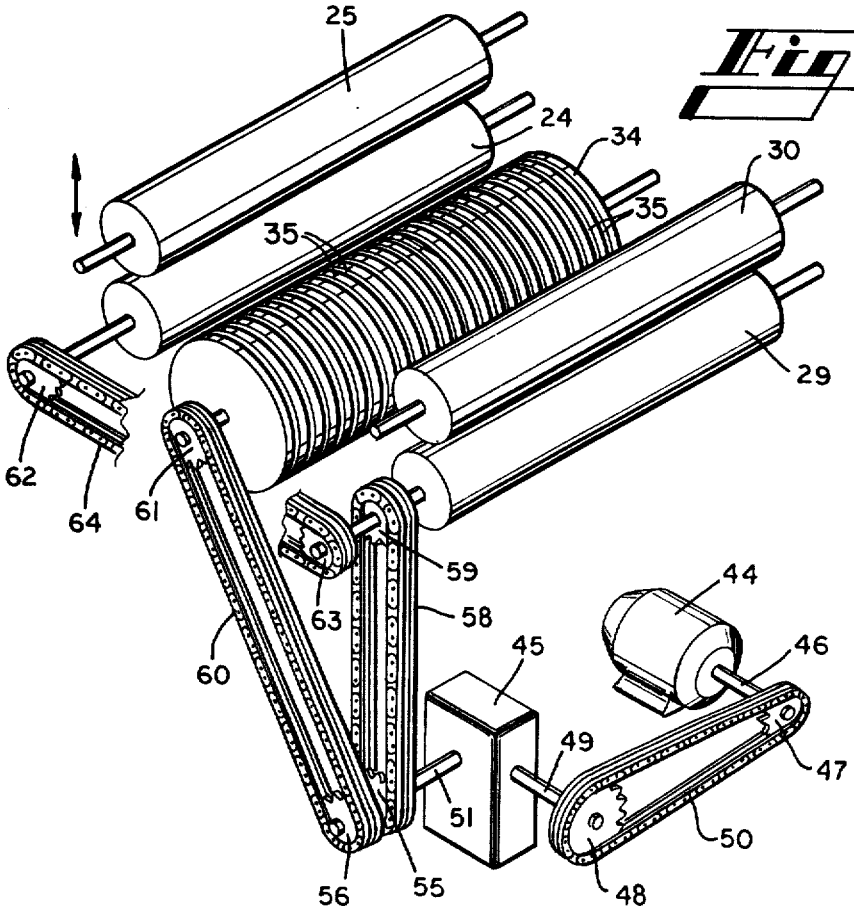
FIG. 3 is an isolated perspective view of the feed roll and grooved roll drive system of the switch cutting apparatus in FIG. 1.

As illustrated in FIG. 3, the first and second feed rolls 24, 29 and the grooved roll 34 are driven at the same rotational speed by a single feed motor 44, the speed of which is reduced through a variable speed gear box 45. Mounted on the motor drive shaft 46 is a drive pulley 47 which drives a driven pulley 48 of the gear box input shaft 49 by a belt 50. Mounted on the output shaft 51 of the gear box 45 is a feed roll driving sprocket 55 and a grooved roll driving sprocket 56. A drive chain 58 extends about the feed roll driving sprocket 55 and a feed roll driven sprocket 59 mounted to the axle of the second feed roll 29. A second drive chain 60 communicates between the grooved roll driving sprocket 56 and a grooved roll driven sprocket 61 mounted to the axle 36 of the grooved roll 34. A first feed roll coupling sprocket 62 is mounted on the axle of the first feed roll 24, a second feed roll coupling sprocket 63 of the same dimensions as sprocket 62 is mounted on the axle of the second feed roll 29, and a timing chain 64 joins the two sprockets 62, 63 so that the feed rolls rotate with equal surface velocities.

The gang slitter 38 is driven during its normal cutting operation by a cutter motor 70, and the drive shaft 73 of motor 70 is connected to gear box 71 which reduces the rpm of the motor to approximately 90 rpm. The gang drive system is located on the opposite side of the swatch cutting apparatus 10 from the feed roll and grooved roll drive system. A third motor 75 is the gang sharpening motor which drives the gang of cutting discs at high rpm, approximately 1000 rpm, when the blades 39 are being sharpened. Mounted rigidly to the gear box output shaft 76 is a conventional clutch plate 77. Beyond the clutch plate 77 to the side furthest from the gear box 71 is a double sprocketed gang driving gear 78, which rotates freely about the gear box output shaft 76 and then a conventional air clutch 79. A third drive chain 80 extends about one sprocket of the double sprocketed gear 78 and the drive shaft sprocket 83 of the sharpening motor 75. The drive shaft sprocket 83 is mounted to the drive shaft 84 through a centrifugal clutch to allow the sprocket to spin freely on the drive shaft 84 when the drive shaft is not itself being rotated by the motor 75. A fourth drive chain 88 communicates between the other sprocket of the double sprocketed gear 78 and driven gear 89 mounted on the rotatable shaft 40 of gang slitter 38.

Figure 5:
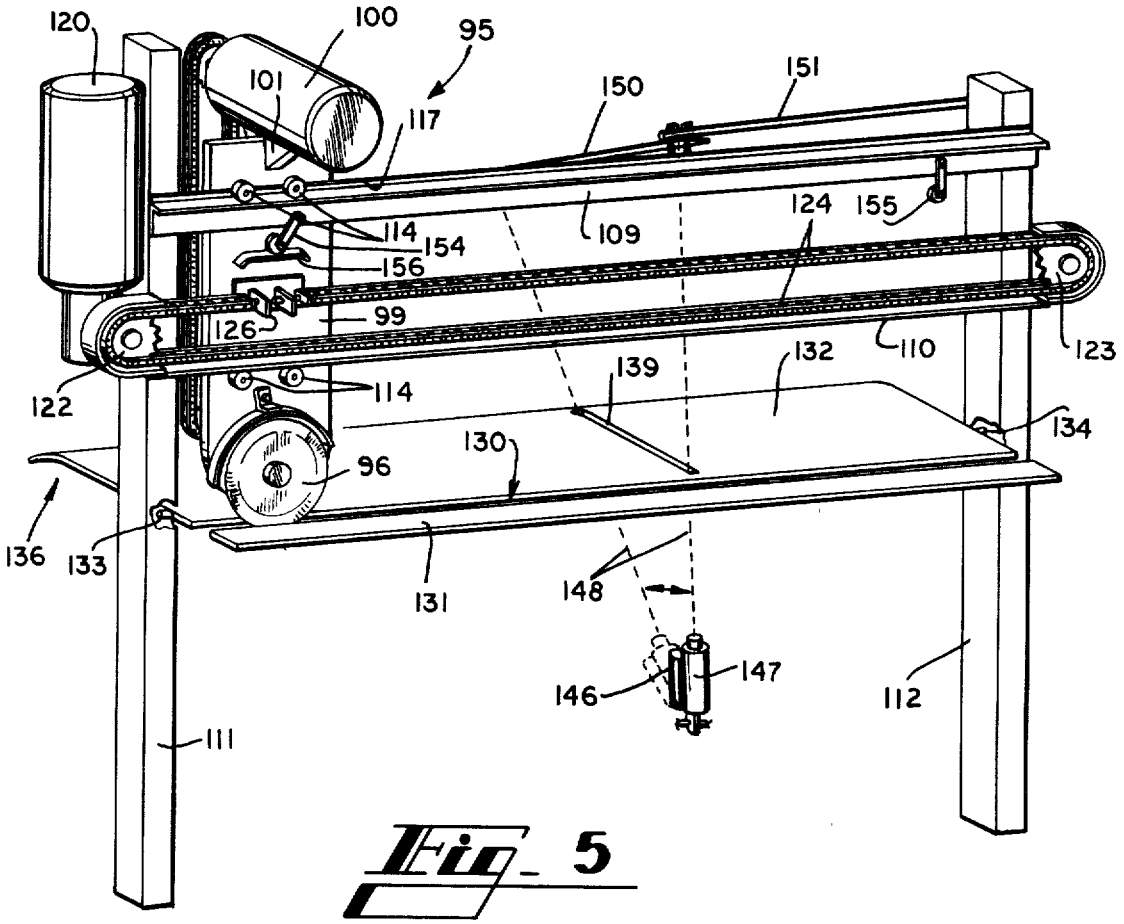
FIG. 5 is a perspective illustration of the swatch cutting apparatus of FIG. 1 taken along line 5—5 of FIG. 2.
Figure 6:
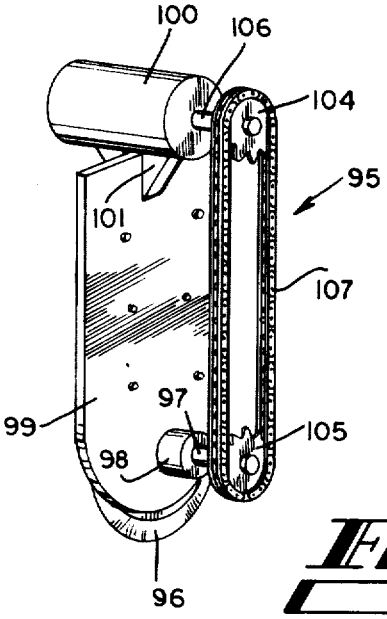
FIG. 6 is an isolated perspective view of the cross cutter of the swatch cutting apparatus in FIG. 1.

Cross cutter 95 is located adjacent the second feed roller 29 toward the swatch collecting end 17 of the swatch cutter 10. As seen in FIGS. 5 and 6, the cross cutter 95 includes a cross cut blade 96 mounted on a rotatable shaft 97 supported through bearings 98 by a support plate 99. The blade 96 is rotated for cutting by a cross cut blade motor 100 which is mounted on top of the support plate 99 and braced with support brackets 101. A cross cut blade driving sprocket 104 is mounted on the drive shaft 106 of the motor 100 and communicates by a fifth drive chain 107 to a driven sprocket 105 mounted on the cross cut blade rotatable shaft 97.

A clamp bar 90, located over the platform 131 between the second nip roll 30 and the cross cut blade 96, is pivotally attached through a link arm 91 to a mounting bracket 92. A clamp operating cylinder 93 with its extendable ram element 94 raises and lowers the clamp bar 90 toward and away from engagement with the platform 132.

As illustrated in FIGS. 2, 5 and 6, the support plate 99 travels laterally across the work surface 21 formed by platform 131 and drop plate 132 along a track comprising two angle beams 109, 110 held by frame legs 111, 112. Four wheels 114 are attached to the support plate 99 and function to guide the plate along the track beams 109, 110. A low lip 117 keeps the wheels on the track or beam 109, 110. A reversible electric motor 120, mounted on one of the frame legs 111, moves the support plate 99 with the attached rotatable shaft 97 and cross cut blade 96 back and forth across the work surface 15 along the track beams 109, 110. The electric motor 120 drives a driving sprocket 122 mounted directly on the motor output shaft, an idler sprocket 123 is mounted on the opposite frame leg 112, and a chain 124 encircles the two sprockets 122, 123. The chain 124 is fastened by a fastening plate 126 to the support plate 99 so that the support plate 99 moves with the chain between the two sprockets 122, 123.

The cross cut blade 96, as it moves laterally across the work surface 15, protrudes below the work surface through a blade channel 130. The blade channel is formed by a gap between a platform 131 of the work surface 21 and a pivotable drop plate 132 which comprises the end of the work surface.

The drop plate 132 is pivoted about pivot pins 133 and 134 which are positioned on each side of the work surface at the front edge of drop plate. Pneumatic cylinder 137 with extendable ram element 138 connected to drop plate 132 causes the drop plate to pivot between a horizontal position and a downwardly sloped position (see FIG. 2). The pivot pins 133, 134 extend into the frame legs 111, 112. The rear edge 136 of the drop plate 132 is sloped downwardly. An elongated rectangular light passage 139 is formed in the drop plate 132 and extends perpendicular to the blade channel 130, that is, longitudinally along the work table 15. Located below, and toward the rear end of the drop plate 132 is a collecting scoop 140.

The control circuit for the swatch cutting apparatus 10 includes a manually triggered start switch (not shown) which activates feed motor 44 and cutter motor 70. A photoelectric cell 146 and light source 147 are rigidly mounted below the work table 15, below the drop plate 132. The cell and light source 146, 147 are adjustable along a vertical plane running parallel to the elongated light passage 139 formed in the drop plate. The light rays 148 emitted from the light source 147 pass through the light passage 139 in drop plate 132 and are reflected by a reflector 150 mounted to the framework. Two limit switches 154, 155 are suspended from the upper angle beam 109 at opposite ends of the beams and are mechanically triggered when engaged by the trigger platform 156 mounted on the support plate 99 as support plate 99 moves toward the end of the track beams 109, 110. A third limit switch 158 is located beneath drop plate 132 and is triggered by the drop plate 132 approaching its lowest pivotal position (as indicated by solid lines in FIG. 2).

OPERATION

In operation, the swatch cutting apparatus 10 cuts the sheet of carpet material 11 (FIG. 7) into a number of rectangular swatches 12. The sheet of carpet material 11 is led by hand over the travel roll 20 onto the work surface 21 of table 15 until it engages the first feed and nip rolls 24, 25. The travel roll 20 prevents the carpet 11 from catching on the edge of the work table 15 as it is moved along its length through the cutting apparatus 10. The first feed roll 24 driven by feed motor 44 feeds the carpet sheet 11 into the gang slitter 38. The wire fingers 42 hold the carpet 11 down against the rotating surface of the grooved roll 34 and rotation of the grooved roll aids in the feeding of the carpet through the gang slitter 38. The cutting blades 39 and the grooved roll are rotated at slow rpm and cooperate in a slicing, scissor like action to cut the carpet 11 into long narrow strips as the carpet is fed through. The annular grooves 35 of the grooved roll 34 act as blade channels to receive the cutting blade edges below the plane of the carpet 11 and the blades thereby cut through the carpet with a scissors action. The cuts 160 (see FIG. 7) made by the plurality of cutting blades 39 are parallel to one another and the width of the strips can be varied by changing the spacing of the gang blades 39 on the rotatable shaft 40.

As the carpet 11 is fed through the gang slitter 38 and cut, it approaches the second feed roll and nip roll 29, 30 which engage the carpet and assist in urging the carpet further along the work table 15 and out over the blade channel 130 onto the drop plate 132. The light source 147 shines through the light passage 139 at a predetermined distance away from the blade channel 130 and thus at a predetermined distance from the cross cut blade 96 traveling along the blade channel. The light 148 from the light source is reflected by reflector 150 back through the light passage to the photocell 146 where the light is detected. When the carpet 11 is fed far enough out along the drop plate 132, it covers more and more of the light passage 139 until the carpet 11 eventually blocks the reflected light rays 148 so the rays are no longer detected by the photo cell 146. At this point, the carpet strips 11 extend the predetermined distance beyond the cross cut blade 96. The absence of light on the photocell 146 activates circuitry in a known manner which turns off the feed motor 44, turns off the gang operating motor 70, activates the clamp operating clyinder 93 to retract ram element 94, turns on the cross cut blade rotating motor 100 and turns on the reversible support plate moving motor 120. This interrupts the movement of the carpet through the apparatus; the clamp bar 90 lowers onto the carpet 11 to hold the carpet against the platform 132; and the cross cut blade 96 moves laterally across the work table 15 as the support plate 99 is pulled along the track beams 109, 110 by the motor 100 and chain 124. The cross cut 161 (see FIG. 7) is thus made in the carpet 11 by the blade 96 perpendicular to the parallel cuts 160 which were made by the blades 39 and forming the previously long carpet strips into rectangular swatches 12. The length of the swatches 12 can be varied by pivoting the light source 147 and photo cell 146 and thereby varying the point at which the light 148 passes through and is reflected back through the light passage 139 in drop plate 132.

When the support plate 99 reaches the end of the track beams 109, 110, the trigger platform 156 engages the respective limit switch 154 or 155 which stops the operation of both motors 100 and 120 and activates the pneumatic cylinder 137 which retracts the ram element 138 to pivot the drop plate 132 downward 11. The newly cut swatches 12 slide off the drop plate 132 into the collecting scoop 140 to a box or other storage device (not shown). When the drop plate 132 reaches its lower most position, the third limit switch 158 is triggered which causes the pneumatic cylinder 136 to lift the drop plate 132 back to its horizontal position and the clamp operating cylinder 93 to raise the clamp bar 90, and which activates the feed motor 44 and cutter motor 70 to begin the feed rolls and gang slitter operating again.

While the invention has been disclosed as a swatch cutter for carpet, it will be understood that various other sheet materials can be treated by the apparatus. Also, while a photo cell has been disclosed as a means for detecting the oncoming leading end of the sheet material to initiate the cross cutting step, it will be understood that various other detecting or actuating means can be used for this purpose. Moreover, while this invention has been described in specific detail with particular reference to a preferred embodiment thereof, it will be understood that variations and modifications can be effected within the spirit and scope of the invention as described hereinbefore and as defined in the appended claims.

What is claimed is:

1. A swatch cutting apparatus for cutting swatches from a carpet strip and like sheet material, said apparatus comprising:

a plurality of spaced apart cutting blades concentrically mounted on a first rotatable shaft;

a grooved roll mounted on a shaft parallel to said first rotatable shaft and defining a plurality of spaced apart annular grooves, each said cutting blade alinged with and protruding into one of said plurality of grooves;

said plurality of cutting blades and said plurality of grooves cooperating to produce a slicing, scissor-like action with respect to a carpet strip moving therebewteen for making a plurality of parallel cuts along the length of the carpet strip;

a first pair of feed rolls positioned on one side of said grooved roll and said cutting blades for moving a carpet strip along its length and along a path first between said grooved roll and said cutting blades;

a second pair of feed rolls positioned on the other side of said grooved roll and said cutting blades for moving the longitudinally cut carpet strip further along its path away from said grooved roll and said cutting blades;

a cross cut blade mounted on a third rotatable shaft for movement along a rectilinear path across the carpet path to make a cut across the longitudinally cut carpet strip perpendicular to said plurality of parallel cuts;

clamp means positioned between said second pair of feed rolls and said cross cut blade for intermittantly holding the cut carpet strip stationary as said cross cut blade cuts across the longitudinally cut carpet strip;

a drop plate positioned after said cross cut blade along the path of the longitudinally cut carpet strip for receiving the end of the longitudinally cut carpet strip, said drop plate including means responsive to the movement of said cross cut blade across the longitudinally cut carpet strip for tilting said drop plate and for discharging the swatches of carpet from the drop plate.

2. Apparatus of claim 1 and further including detecting means for detecting the presence of carpet at a predetermined distance beyond the path of said cross cut blade and for automatically stopping the feeding of the carpet and moving said cross cut blade across the carpet in response to detecting the presence of carpet.

3. A swatch cutting apparatus for cutting swatches from a carpet strip and like sheet material, said apparatus comprising:

a plurality of spaced apart circular cutting blades concentrically mounted on a first rotatable shaft for cutting the carpet strip with scissors cuts to form a plurality of longitudinally extending parallel cuts in the carpet strip;

a first pair of feed rollers for feeding the uncut carpet strip along its length and along a path first into the plurality of cutting blades;

at least one circular cross cut blade moveable laterally across the length of the longitudinally cut carpet strip for cutting the carpet strip with a cut perpendicular to said plurality of parallel cuts;

a second pair of feed rollers for feeding the longitudinally cut carpet strip to said cross cut blade;

a drop plate for receiving the longitudinally cut carpet strip from said second pair of feed rollers and from said cross cut blade, said drop plate defining a slot therethrough extending parallel to the path of movement of the longitudinally cut carpet strip;

detector means for detecting the position of the leading end of the longitudinally cut carpet strip as the carpet strip moves along the slot of said drop plate; and, control means responsive to said detector means to move said cross cut blade across the longitudinally cut carpet strip to cut across the carpet strip to cut the carpet strip into swatches and responsive to the movement of said cross cut blade across the carpet strip to tilt the drop plate and discharge the carpet swatches.

4. Apparatus of claim 3 and further including clamp means for releasibly engaging the sheet material to hold the material while said cross cut blade cuts across the length of the carpet strip.

5. A method of cutting swatches from a sheet of material, said method comprising:

rotating a plurality of spaced apart circular cutting blades in parallel planes about a common axis;

moving the sheet material along its length with a first pair of rotatable feed rolls into and through the plurality of cutting blades to simultaneously form a plurality of parallel cuts in the sheet material thus forming the sheet material into a plurality of strips of predetermined width;

moving the leading edge of the longitudinally cut sheet material with a second pair of rotatable feed rolls beyond the path of a cross cut blade;

detecting the presence of the longitudinally cut sheet material at a predetermined distance beyond the path of the cross cut blade;

stopping the movement of the longitudinally cut sheet material in response to detecting the presence of the sheet material at the perdetermined distance beyond the cross cut blade;

engaging the longitudinally cut sheet material with a clamp means adjacent the position where a cross cut blade is to cut across the longitudinally cut sheet material after the leading edge of the sheet material has been moved the predetermined distance beyond the path of the cross cut blade in response to detecting the presence of the sheet material at the predetermined distance beyond the cross cut blade to hold the sheet material firmly in position while the cross cut blade is moved laterally across the length of the sheet material;

moving the cross cut blade laterally cross the length of the sheet material to make a cut in the sheet material perpendicular to the plurality of parallel cuts and to form the sheet material into swatches of predetermined length; and discharging the swatches in response to the movement of the cross cut blade across the length of the sheet material.

* * * * *